United States Patent [19]

Russell

[11] 4,232,810

[45] Nov. 11, 1980

[54] STRING STAPLER

[75] Inventor: B. Carson Russell, Omaha, Nebr.

[73] Assignee: Carlson Stapler and Shippers Supply, Inc., Omaha, Nebr.

[21] Appl. No.: 950,125

[22] Filed: Oct. 10, 1978

[51] Int. Cl.[2] ..... B25C 1/04

[52] U.S. Cl. ..... 227/19; 227/12

[58] Field of Search ..... 227/12, 19, 20, 46, 227/76, 89, 120

[56] References Cited

U.S. PATENT DOCUMENTS

| | | | |
|---|---|---|---|
| 2,637,030 | 5/1953 | Wickman et al. | 227/151 |
| 3,283,986 | 11/1966 | McKee | 227/120 |
| 3,310,215 | 3/1967 | Bostick | 227/120 X |
| 3,476,302 | 11/1969 | Hurd | 227/120 |
| 3,771,708 | 11/1973 | DeNicola et al. | 227/120 X |

*Primary Examiner*—Paul A. Bell

*Attorney, Agent, or Firm*—Hiram A. Sturges

[57] ABSTRACT

A string stapler comprising a stapling gun, a string guide guiding string from a spool to a position under the staple outlet of the gun whereby an operator can dispense string and also staple the string in place with a same unit, a hollow string-spool axle being mounted at the air inlet of the gun.

5 Claims, 10 Drawing Figures

STRING STAPLER

BACKGROUND OF THE INVENTION

In the past it has been customary in low winds to simply attach tar paper to the sheeting of the roof of a house by special nails, but more recently by staples sometimes applied by a pneumatic stapling machine.

Because of the problem of higher winds it has been customary to install the staples through discs of plastic material, or thin metal material to apply pressure on the tar paper over a larger area. With these methods successful results are achieved, except when the wind becomes high. If there is a high wind it is necessary to apply the roofing shingles quickly after placing the tar paper in place and before the wind can blow a section of tar paper away. When winds are high, or expected to be, then it is not practical to tar paper many houses in a row with a tar papering crew in mass production and to follow it up with a roofing shingle crew afterwards. In the meantime all the tar paper would be ripped away by the wind.

My solution to this problem is the application of a string on top of the roofing and held in place by staples applied by a stapler, on which a ball of twine is mounted.

This solution is much superior to the application of long pieces of wooden lath by means of staples, because it is impossible to place roofing shingles over the lath. Roofing shingles can be placed over the string and staple combination without difficulty, but it would be necessary to completely remove the lath before roofing shingles could be put in place. Even while removing the lath, the wind might tear away sections of the tar paper on a high wind day.

I conceive that the twine could be applied over the tar paper in either a straight line for greatest speed or could be applied in a zig-zag configuration for spreading out the load well over the area of the tar paper for minimizing wind-tearing.

An object of this invention is, therefore, to provide a twine mounting assembly, mounted in position for best balance, so that the tool is easy to handle.

It is my concept that the position of best balance is to place the axle for the twine in alignment with that portion of the pneumatic hose that attaches directly to the gun, the problem of the factor that this position is occupied necessarily by an air line being solved by providing a tubular twine axle disposed around the air line so that air line can extend directly through the tubular twine axle, whereby the air hose is attached to the other end of the rigid air line so that the closer end of the air hose is connected to rigid parts of the total assembly which can be called a string stapler as close to that position on the gun that had previously been proven to be the position for attachment for best gun balance in handling the stapling gun and the hose in fast work.

A further object of this invention is to provide an economy by using the tubular twine axle as a rigid air line, rather than having an air line extending through the twine axle. This way makes possible attachment by simple threading, and also makes possible the holding of the twine axle in rigid position such that it will not rotate.

Another object is to provide a twine guide assembly provided with forward and rearward mountings, which latter have openings for receiving the twine axle, the openings having keys and the axle having a key way, so as to rigidly fix the twine guiding assembly in position, so that the eye thereof stays to one side of the gun where the twine is best lead forwardly to a forward holding twine eye which holds the twine in a position for extending directly under the position from which a staple leaves the gun.

A further objective is to provide a simpler forward twine holding eye mounting for use with guns on which staples are mounted from the upper side of a staple magazine, which latter ordinarily extend horizontally and are loaded with staples, either from the top or the bottom. When the stapler magazine or feed is to be loaded from the bottom, then it is an object of this invention to provide a special forward twine holding eye mounting, which is adapted to be moved out of a position of blocking the magazine so that the magazine can be opened for a staple loading operation.

Still another objective is to provide a twine cutter and a twine gripper which I conceive can be combined into one unit.

Yet another objective is to provide a regulatable resistance to rotation of a twine spool around the twine axle, accomplished by a threaded nut applying pressure on one end of the twine spool, while the other end of the twine spool is held from longitudinal movement by a flange on the axle.

Resistance to unrolling of the twine spool is desirable for facilitating the tight stretching of the twine in the area between an applied staple and a stable about to be applied. It is desirable that the amount of tension can be varied to the desires of the workman applying the staples.

SUMMARY OF THE INVENTION

A major object of this invention is to provide a string stapler comprising a staping gun having a frame to which a string guide is attached which guides string from a spool to a position under the staple outlet of the gun, the spool being mounted on a hollow axle so that it can rotate freely, the axle being attached to the frame at the air inlet of the gun so that compressed air can enter the gun through the axle and through the inlet whereby no special means on the gun is needed for mounting a spool axle and the standard threaded wall of the air inlet serves this purpose.

Another object of this invention is to provide for a string spool to be mounted on a gun rearwardly of the handle since the staple outlet is itself at the forward end of a gun, whereby the handle is disposed between the forward end of the gun and the rearward end of the string spool where the gripping of the handle gives the best balance.

Yet another objective is to provide for a string guide which is an eye disposed beneath the gun rearwardly of the staple outlet to be movable so that the guide is not in the way during the loading of staples when the gun is of the type into which staples are loaded from the other side.

Another goal of this invention is to provide a handy twine cutter at the forward end of the gun which will grip a segment of twine while providing a cutting edge in which the end of that segment can be quickly cut.

DESCRIPTION OF THE PREFERRED EMBODIMENT

Figures 1, 1A, 2, 3, 4, 5, 5A:
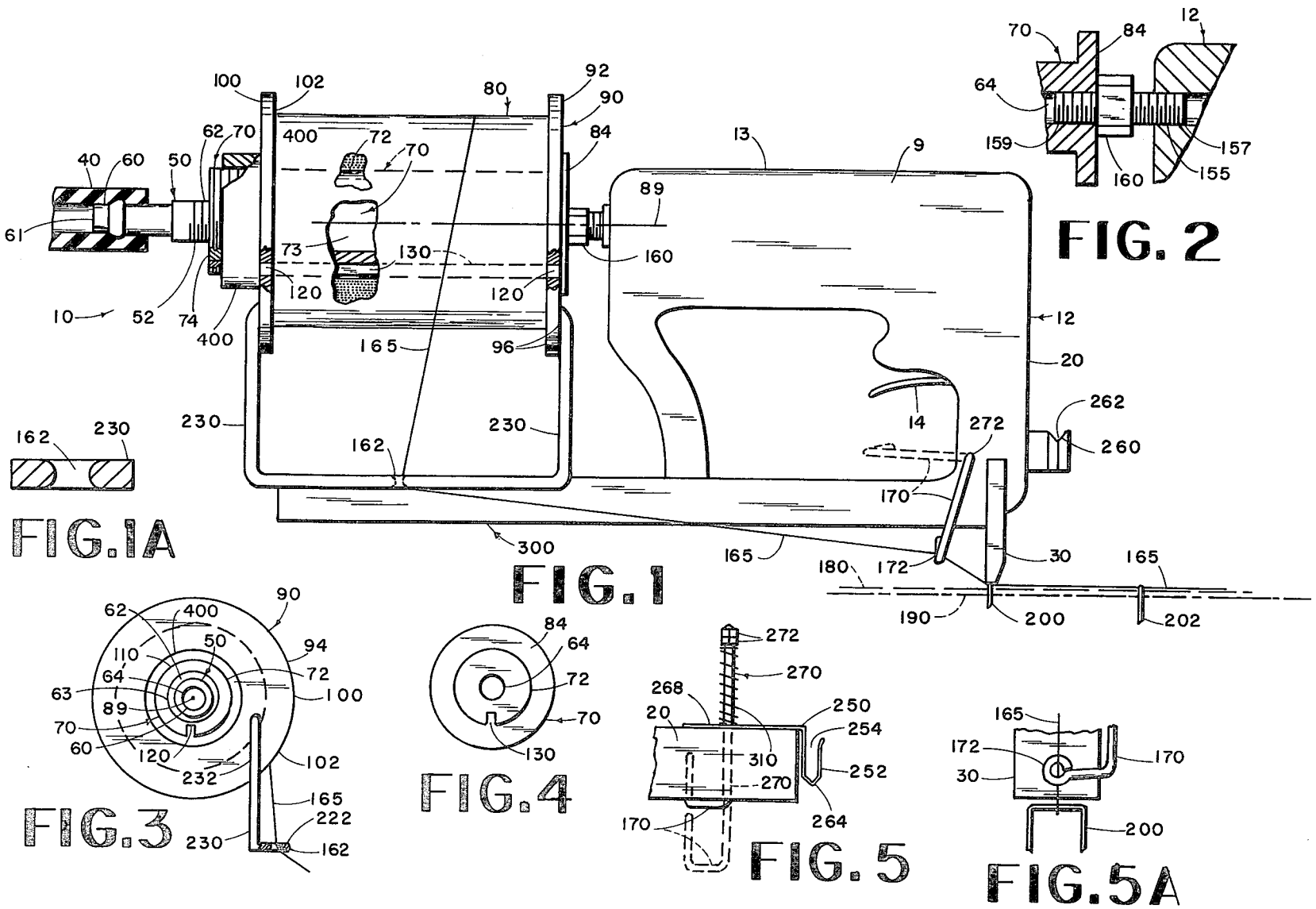
FIG. 1 is a side elevation of the string stapler of this invention, with parts thereof broken away, and shown as attached to a segment of hose, which is shown in cross section, a forward string guide being shown in full line in operational position and in dotted line in storage position. Positions of tar paper and roof sheathing are shown in dotted lines, and position of staples are shown in full lines.
FIG. 1A is a detail showing a rearward string eye portion of an eye bracket with a forward side thereof removed and the remainder showing in section.
FIG. 2 is a detail showing a portion of the rearward end of the gun handle and of the forward end of a spool axle, shown in section, and also showing full lines a connector fitting.
FIG. 3 is a detail showing the rearward end of the string spool and string holder and an eye bracket with a nipple being shown with a portion of string, the rest of the string stapler not being shown. A part of the eye is broken away.
FIG. 4 is a front elevation of the spool carrier with other parts of the string stapler not showing.
FIG. 5 is a top plan view of the forward end of the stapler, showing an eye carrier in dotted lines in an alternate position used during loading of staples.
FIG. 5A is a rear elevation of a lower part of the string stapler with all upper parts broken away with the exception of a lower portion of the forward string director and adjacent parts of the staple guide 30. The view also shows a string in place running under a staple.

The string stapler of this invention is generally indicated at 10 in FIG. 1, and comprises a stapling gun, generally indicated at 12, and having a trigger 14 mounted on its body 20 for ejecting staples by pneumatic force down through a staple guide 30, the pneumatic force reaching the body 20 of the gun at the rearward end of the handle 9 from an air hose 40 connected to a hose fitting or air inlet port 50, provided with a nipple at 60 received in the hose 40.

The fitting 50 has a threaded forward end 52, threadedly received in the internally threaded rearward end opening 62 of an end closure 63 fixed in a forwardly-to-rearwardly extending cylindrical opening 64 in a hollow string spool carrier or axle 70. The spool axle 70 has a cylindrical exterior surface 72, around which the cylindrical interior of a string spool 80 is rotatably received, and the spool axle 70 also has an open center 73.

The string spool 80 has a forward end flange 84 extending transversely through a rotational axis 89, which latter extends forwardly-to-rearwardly through a center of the carrier 70.

The purpose of the forward flange 84 is to engage the forward side of a forward plate 92 of a string guide assembly, generally indicated at 90, which latter is circular on its exterior 94, and is provided with forward and rearward sides 96, which are planar and at a right angle to the axis 89.

The forward plate 92 is identical to a rearward plate 100, which also has planar forward and rearward sides at 102, at a right angle to the axis 89.

As best seen in FIG. 3, a rear view of the string guide assembly 90 shows that the plate 100 and the forward plate 92, which are identical, each have a circular central opening 110, extending forwardly to rearwardly therethrough along the axis 89, the opening 110 being substantially circular but for the exception of the rearward spool-plate 100 having a key 120 protruding upwardly from a lower side thereof into the opening 110 from it lower edge and toward the axis 89.

The keys 120 in the plates 92 and 100 are for the purpose of the reception in a key-way 130 which extends parallel to the axis 89 and along the underside of the cylindrical portion 72 of the carrier 70, about which the string spool 80 is disposed, all as best seen in FIG. 4, which shows the carrier 70 in rear view, as seen from the left side of FIG. 1.

Air under pressure passes from the hose 40 through the fitting 50, through the air passage 64, extending through the cylindrical portion 72 of the carrier 70 to a forward air fitting 160, threaded into the forward end of the air passage 64, and through the center of the fitting 160 to the interior of the stapler gun body 20 for the operation of the stapler 12 in the usual way.

The forward air fitting 160 has a central hexagonal wrenching portion 161 and forward and rearward externally threaded portions 157 and 159 threadedly received in the internally threaded inlet 155 of the frame 13 of the gun 12.

The string guide assembly 90 has an eye 162, through which string from the spool 80 extends. The eye 162 is disposed beneath the spool 80 approximately midway between the plates 92 and 100, and string 165 extends downwardly from the spool 80 through the eye 162 and forwardly through a forward string director or string guide 170, and specifically through the eye or string cradling concave surface 172 of the string director 170, whereby with the string held down against tar paper roofing material, indicated in dotted lines at 180, in FIG. 1, by the position of the gun 12, and at the lower end of its guide 30, then a staple fired from the gun 12 through the guide 30 will straddle the string 165 therebeneath, with the ends of the staple embedded in roof sheeting 190, as shown at 200 in FIG. 1, a staple previously driven being shown at 202 in FIG. 1.

The eye 162 has a vertical eye opening 222 therethrough, as best seen in FIG. 3.

The eye 162 is held in place by an eye bracket 230, having upwardly extending arms fixed to the forward side of the forward plate 92, and to the rearward side of the rearward plate 100, such as by welding at 232, as best seen in FIG. 3.

When the operator wishes to cut the string 165 he can pass it quickly into a cutter, generally indicated at 250 and having a generally U-shaped portion 252, having an opening 254 in its side for receiving the string, the opening being easily cut by a sharp edge 260 of a notch 262 on the innermost part 264 of the U-shaped portion 252, as best seen in top plan view in FIG. 5.

The cutter 250 can be held in place by having one end 268 thereof held in place by a threaded support 270, which extends completely through the gun body 20 at an opening 272 horizontally therethrough at the upper end of the forward eye carrier 170, whereby the latter extends downwardly across a staple magazine 300 of the gun 12 to hold the eye 172 in the described position, even though the eye carrier 170 is supported from a position above the magazine 300 and adapted to get out of the way of the magazine 300 during loading as is necessary on some kinds of staple guns.

In order to let the forward eye carrier 170 get out of the way of the magazine 300, the support or arm 270 extends a substantial distance to one side of the gun to nuts 272 fixed thereon which hold a compression spring 310 in place around the support 270 so that when the outer end of the support 270 is pushed toward the gun then the eye carrier 170 will move away from the opposite side of the gun sufficiently to be of no interference with the loading of the magazine 300. The inner end of the spring 310 also serves to press against the portion 268 of the cutter 250 through which the carrier 170 extends so as to hold the cutter in place.

Figure 6:
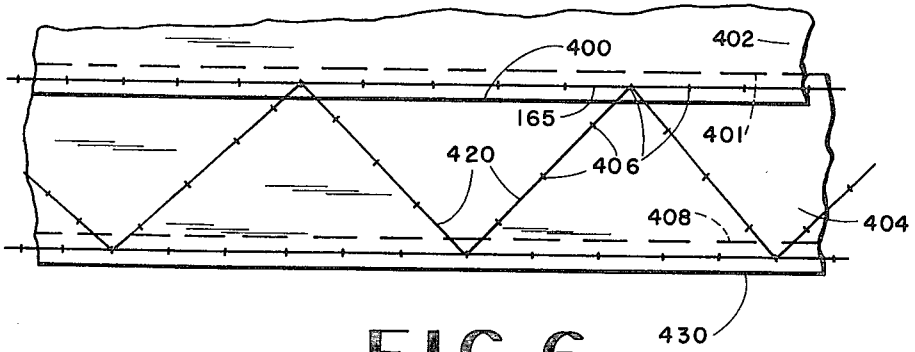
FIG. 6 shows a top plan view of a pair of elongated strips of tar paper for covering a roof with the lower edge of the upper tar paper lapping the lower edge of the lower tar paper with the dotted edge of the lower tar paper being shown under the upper tar paper and with a dotted line being shown adjacent the lower edge of the view to indicate the position of the upper edge of still another tar paper, not shown. The view further shows positions in which strings and staples have been placed, the staples being driven into roof sheeting, not shown.

In FIG. 6 overlapped edges 400 and 401 of two tar paper roof sheets 402 and 404 are shown, and the string 165 can extend straight down the overlap with spaced staples 406 holding the string in place.

The string at 420 can also be zig-zagged across the tar paper roof sheets. Another tar paper sheet is shown at 430 with an under edge 408. The string can be used to hold insulation 450 of a bat-type in place. Studs are shown at 460 and insulation from a roll is put in place at 450.

Figure 8:
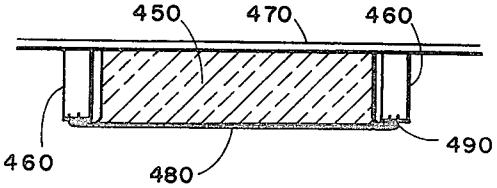
FIG. 8 is a view taken in section through the portion of a wall shown in FIG. 7, and showing the studdings and outside sheeting of the vertical wall with the insulation in place thereon shown in cross section.
Figure 7:
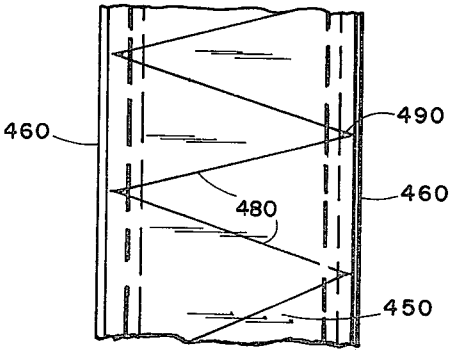
FIG. 7 is a top plan view of a pair of studdings with a bat of insulation received thereon, and with the bat extending over the inner sides of the studdings somewhat, the position of strings stapled in place by the stapler of this invention being shown thereon.

In FIG. 8 a top plan view makes it easier to understand. Insulation 450 can even be put on the FIG. 8. FIG. 8 is not a top plan view but is a view looking horizontally with the studs 460 being ceiling joists under a roof 470.

Tension on the spool 80 is controlled by tightening the nut 400 variously to press the plates 92 and 100 towards each other to pressure the spool 80. When the nut 400 is not pressing, the plates 92 and 100 are spaced apart farther than the length of the spool 80 because of springiness or resilience of the bracket 230.

I claim:

1. A string stapler comprising a stapling gun having a frame provided with a substantially elongated handle extending forwardly and rearwardly, said gun having an air inlet port on its rearward side behind said handle, said frame having a downward opening staple outlet having a substantially elongated shape extending from right to left, said outlet being disposed forwardly of said handle, a staple magazine fixed to said frame, staples in said magazine having recesses extending upwardly thereinto from the lower ends thereof, a trigger mounted on said frame, said gun delivering a staple from said magazine out through said outlet upon operation of said trigger when said air inlet port is connected to a source of pneumatic pressure, a string guide between said outlet and the rearward end of said handle whereby said gun is adapted to be moved rearwardly during operation between shooting of staples, means connecting said string guide to said frame, said string guide having a string cradling concave surface facing upwardly and having its lowermost part behind said staple outlet so that when a taut string extends across said string cradling surface closely under said staple outlet and forwardly from said staple outlet it will be bridged by such a staple shot from said outlet, a string spool disposed rearwardly of said handle, a string spool attaching assembly attaching said string spool rotatably to said frame, a string directing assembly attached to said frame rearwardly of said outlet and guiding said string from said spool forwardly to said string cradle.

2. The string stapler of claim 1 having said gun frame having an internally threaded air entry port on its rear ward side, said spool attaching assembly having a hollow axle provided with an air inlet means at its rearward end, a fitting attached to the forward end of said hollow axle and threadedly received in said threaded air entry port of said frame.

3. The string stapler of claim 1 having said spool having a center axis extending forwardly to rearwardly through the center thereof, said string directing assembly being disposed to one side of said center axis.

4. The string stapler of claim 1 having said means connecting said string guide to said frame being an arm extending upwardly from said string cradling concave surface to said frame and located on one side of said frame.

5. The string stapler of claim 1 having said string guide provided with an arm, said arm extending completely through said frame and outwardly from one side of said frame, said arm being movable so that it can extend outwardly from said frame on either side of said frame, a spring engaging means carried by said arm at a point outside of said frame, said arm having a spring disposed therearound between said spring engaging means and said frame, said spring urging said string guide to a position substantially directly behind said staple outlet, compression of said spring causing said string guide to move to a position substantially to one side of said frame for the purpose of easy threading of string through said string guide.

* * * * *